US008811867B2

(12) United States Patent
Ichihashi et al.

(10) Patent No.: US 8,811,867 B2
(45) Date of Patent: Aug. 19, 2014

(54) TRANSFER DEVICE AND IMAGE FORMING APPARATUS USING SAME

(71) Applicants: Osamu Ichihashi, Sagamihara (JP); Ryuuichi Mimbu, Ebina (JP); Kenji Sengoku, Kawasaki (JP); Junpei Fujita, Sagamihara (JP)

(72) Inventors: Osamu Ichihashi, Sagamihara (JP); Ryuuichi Mimbu, Ebina (JP); Kenji Sengoku, Kawasaki (JP); Junpei Fujita, Sagamihara (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/796,167

(22) Filed: Mar. 12, 2013

(65) Prior Publication Data

US 2013/0189002 A1 Jul. 25, 2013

Related U.S. Application Data

(63) Continuation of application No. 12/877,469, filed on Sep. 8, 2010, now Pat. No. 8,417,164.

(30) Foreign Application Priority Data

Sep. 15, 2009 (JP) ..... 2009-213068

(51) Int. Cl.
*G03G 15/01* (2006.01)

(52) U.S. Cl.
USPC ..... 399/308; 399/302; 399/313; 399/316; 399/317

(58) Field of Classification Search
USPC ..... 399/66, 121, 299, 302, 308, 313, 316, 399/317
See application file for complete search history.

(56) References Cited

U.S. PATENT DOCUMENTS

| | | | | |
|---|---|---|---|---|
| 6,061,542 | A | 5/2000 | Minami et al. | |
| 6,201,944 | B1 | 3/2001 | Onuki et al. | |
| 8,165,484 | B2 * | 4/2012 | Murayama | 399/66 |
| 2007/0116496 | A1 | 5/2007 | Morimoto et al. | |
| 2009/0190971 | A1 | 7/2009 | Inui et al. | |
| 2011/0158690 | A1 | 6/2011 | Mimbu et al. | |

FOREIGN PATENT DOCUMENTS

| | | | |
|---|---|---|---|
| CN | 1864107 | A | 11/2006 |
| CN | 101498914 | A | 8/2009 |
| JP | 2005-215704 | | 8/2005 |
| JP | 2007-178938 | | 7/2007 |

(Continued)

OTHER PUBLICATIONS

Office Action issued Apr. 28, 2012 in Chinese Patent Application No. 2010-10284114.5.

(Continued)

*Primary Examiner* — Hoang Ngo
(74) *Attorney, Agent, or Firm* — Oblon, Spivak, McClelland, Maier & Neustadt, L.L.P.

(57) ABSTRACT

A transfer device includes a plurality of rollers, a rotatable intermediate transfer belt wound around and stretched between the rollers, a transfer member disposed in the inner loop of the belt and facing an image bearing member of an image forming apparatus disposed at an outer circumference of the belt, to transfer an image formed onto the surface of the image bearing member when contacting the intermediate transfer belt, and a position adjuster to adjust the position of the intermediate transfer belt at different positions relative to the image bearing member. The positions include a contact state in which the intermediate transfer belt applied with a predetermined tension contacts the image bearing member, a first separation state in which the tensioned intermediate transfer belt separates from the image bearing member, and a second separation state in which the intermediate transfer belt separates further away from the image bearing member.

20 Claims, 7 Drawing Sheets

(56) References Cited

FOREIGN PATENT DOCUMENTS

| | | |
|---|---|---|
| JP | 2008-129448 | 6/2008 |
| JP | 2008-233196 | 10/2008 |
| JP | 2008-276103 | 11/2008 |
| JP | 2009-58681 | 3/2009 |

OTHER PUBLICATIONS

Office Action issued Jul. 12, 2013 in Japanese Application No. 2009-213068.

Office Action issued Oct. 11, 2013 in Japanese Patent Application No. 2009-213068.

* cited by examiner (a)

(b)

(c)

(a)

(b)

(c)

TRANSFER DEVICE AND IMAGE FORMING APPARATUS USING SAME

CROSS-REFERENCE TO RELATED APPLICATIONS

This application is a continuation of U.S. application Ser. No. 12/877,469, filed Sep. 8, 2010, and is based on and claims priority pursuant to 35 U.S.C. §119 from Japanese Patent Application No. 2009-213068, filed on Sep. 15, 2009 in the Japan Patent Office, which are hereby incorporated herein by reference in their entirety.

BACKGROUND OF THE INVENTION

1. Field of the Invention

Exemplary aspects of the present invention generally relate to a transfer device that transfers an image formed on an image bearing member, and an image forming apparatus, such as copiers, facsimile machines, or printers, using the transfer device.

2. Description of the Background Art

Conventionally, image forming apparatuses such as copiers, facsimile machines, or printers include a developing device that develops what is called an electrostatic latent image formed on an image bearing member, for example, a photoreceptor, with toner to form a visible image, also known as a toner image; a transfer device that transfers the toner image onto a transfer member; and a fixing device that fixes the toner image onto the transfer member.

In the case of color image forming apparatuses such as color copiers and color printers capable of producing a color image, the color image forming apparatus is equipped with a plurality of developing devices for different colors, black, cyan, magenta, and yellow, to form toner images of each respective color. After forming the toner images on each of the photoreceptors, the toner images are sequentially and overlappingly transferred onto an intermediate transfer belt while the intermediate transfer belt rotates, thereby forming a composite color toner image on the intermediate transfer belt. Then, the composite color toner image is transferred from the intermediate transfer belt onto a transfer member, for example, a recording medium, and fixed on the recording medium by the fixing device to form a color image on the recording medium as the output.

Conventionally, in the transfer device of the color image forming apparatus, the intermediate transfer belt is wound around a plurality of rollers. Consequently, if such rollers are deformed or are not properly installed, desired parallelism of the intermediate transfer belt between the rollers is not obtained, causing the intermediate transfer belt to drift laterally, that is, in a width direction thereof, as it rotates. As a result, distortion or color drift may occur in a resulting output image, thus degrading imaging quality. Prevention of undesirable drift of the intermediate transfer belt is of critical importance for pursuing high imaging quality.

To address such difficulty, Japanese Unexamined Patent Application No. 2007-178938 (JP-2007-178938-A) proposes a method for preventing drift of the intermediate transfer belt. The method includes a plurality of rollers that rotatably supports the intermediate transfer belt, one of which supports the intermediate transfer belt in an inclined manner. This roller is a so-called steering roller, which is inclined based on the position of an end portion of the intermediate transfer belt as detected by a detector to prevent the intermediate transfer belt from drifting.

In such a method, the position of the intermediate transfer belt in a main scanning direction is regulated by resistance of contact between the surface of the intermediate transfer belt and the steering roller. Thus, the reliability of drift adjustment relies largely on the tension of the belt, which is a key factor for determining the resistance of contact between the surface of the intermediate transfer belt and the steering roller.

Unfortunately, a variety of factors complicate maintenance of the proper tension on the intermediate transfer belt. Such factors include conventional techniques to extend the lifespan of the intermediate transfer belt and the photoreceptors, as described below, as well as methods of improving cleaning performance and even the type of imaging information involved.

When forming a monochrome image in the color image forming apparatus to extend the lifespan of the intermediate transfer belt and the photoreceptors, there is known a method in which the intermediate transfer belt is separated from the photoreceptors of cyan, magenta, and yellow toners.

By contrast, in another known method for extending the lifespan of the intermediate transfer belt and the photoreceptors, all the photoreceptors are separated from the intermediate transfer belt upon completion of an image forming operation. In this configuration, before rotation of the photoreceptors and the intermediate transfer belt is halted, all the photoreceptors are separated from the intermediate transfer belt upon completion of the image forming operation. Accordingly, damage caused by abrasion due to a difference in linear velocities of the photoreceptors and the intermediate transfer belt when stopping rotation of the photoreceptors and the intermediate transfer belt may be prevented.

There are other instances in which the intermediate transfer belt is separated from the photoreceptors. For example, when a lubricating agent is applied to the intermediate transfer belt and/or when the intermediate transfer belt is rotated in reverse for better cleaning, the intermediate transfer belt is separated from the photoreceptors. Typically, the lubricating agent is applied when the image forming apparatus is used for the first time or after replacing the intermediate transfer belt with a new belt.

In order to separate the intermediate transfer belt from the photoreceptors, the rollers that wind and stretch the intermediate transfer belt need to be moved. Unfortunately, moving the rollers causes a path along which the intermediate transfer belt moves to change, thereby changing undesirably the tension of the intermediate transfer belt. As noted, when the tension of the intermediate transfer belt changes undesirably, the resistance of contact between the intermediate transfer belt and the rollers including the steering roller changes, thereby complicating efforts to control the position of the intermediate transfer belt in the main scanning direction.

Furthermore, the belt tension also changes when the image forming apparatus receives image information consisting of both a monochrome and color images. In such a case, the print mode is switched between the monochrome print mode and the color print mode, thus changing the moving direction of the intermediate transfer belt. As a result, the speed of the intermediate transfer belt fluctuates undesirably, causing distortion and/or color drift in the resulting output image.

The tension of the intermediate transfer belt also changes when automatically applying the lubricating agent to the intermediate transfer belt. In order to apply the lubricating agent to the intermediate transfer belt, the intermediate transfer belt is separated from all the photoreceptors while rotating. As a result, the belt tension may be reduced and the belt thus loosened, thereby undesirably contacting other parts of the image forming apparatus and thus getting damaged.

Another difficulty derived from this configuration is that when automatically applying the lubricating agent onto the intermediate transfer belt, the intermediate transfer belt is separated from all photoreceptors from a single point. This separation point does not change even when replacing the intermediate transfer belt or the transfer device or the photoreceptors. In addition, the gap between the intermediate transfer belt and the photoreceptors when the intermediate transfer belt is separated is relatively narrow, complicating replacement of the above mentioned parts and causing the intermediate transfer belt to undesirably come into contact with the photoreceptors and other parts.

In view of the above, JP-2008-233196-A proposes an image forming apparatus equipped with a transfer unit to reduce fluctuation of the tension of the intermediate transfer belt between the monochrome print mode and the color print mode. The transfer unit includes link members serving as a tension adjustment mechanism for the transfer belt. The link members adjust the tension of the transfer belt in conjunction with a plurality of transfer rollers separating from the photoreceptors disposed opposite the transfer rollers.

In the above-described approach, a spring, which urges a tension roller which is one of the rollers around which the intermediate transfer belt is wound, is attached to one end of the link member. The tension roller is urged by the spring against the intermediate transfer belt. By moving the link members, the length of the spring does not change significantly between the monochrome print mode and the color print mode, thereby suppressing fluctuation of the tension of the intermediate transfer belt.

Although advantageous, this configuration has a drawback in that because the tension of the intermediate transfer belt is adjusted by moving the tension roller urged by the spring in accordance with the movement of the color transfer rollers corresponding to the photoreceptor drums, causing the link members to move in conjunction with the movement of the tension roller, significant stress may be applied on the parts used in this operation.

Furthermore, the position of the transfer roller for black is fixed. This means that the transfer roller for black does not separate from the intermediate transfer belt. Yet JP-2008-233196-A does not disclose the automatic application of the lubricating agent while the intermediate transfer belt is separated form all photoreceptor drums and rotated, nor does it disclose how the intermediate transfer belt is prevented from getting damaged when replacing the intermediate transfer belt or the transfer device or the photoreceptors, either.

In view of the above, there is demand for a device capable of minimizing operational load on the intermediate transfer belt and/or adjacent components when the intermediate transfer belt contacts or separates from the photoreceptor drums while preventing fluctuation of the tension of the intermediate transfer belt, thus preventing loosening and drift of the intermediate transfer belt in the main scanning direction.

SUMMARY OF THE INVENTION

In view of the foregoing, in one illustrative embodiment of the present invention, a transfer device includes a plurality of rollers, a rotatable intermediate transfer belt, a transfer member, and a position adjuster. The plurality of rollers includes at least two support rollers and a backup roller. The rotatable intermediate transfer belt is wound around and stretched between the plurality of the rollers. The transfer member is disposed in the inner loop of the intermediate transfer belt and faces an image bearing member of an image forming apparatus within which the transfer device is installed. The image bearing member is disposed at an outer circumference of the intermediate transfer belt, to transfer an image formed on the surface of the image bearing member when contacting the intermediate transfer belt. The position adjuster adjusts the position of the intermediate transfer belt at a plurality of positions relative to the image bearing member and includes a support member that rotatably supports the transfer member and the backup roller. The backup roller moves in conjunction with the transfer member when the support member moves to adjust the position of the intermediate transfer belt relative to the image bearing member. The plurality of positions includes a contact state in which the intermediate transfer belt having a predetermined tension contacts the image bearing member, a first separation state in which the intermediate transfer belt having a predetermined tension separates from the image bearing member, and a second separation state in which the intermediate transfer belt separates further away from the image bearing member than in the first separation position.

In another illustrative embodiment of the present invention, a transfer device includes the plurality of rollers, the rotatable intermediate transfer belt, a plurality of transfer members, and at least two position adjusters. The plurality of transfer members is disposed in an inner loop of the intermediate transfer belt, each facing a respective one of the plurality of image bearing members for bearing toner images disposed at an outer circumference of the intermediate transfer belt, to transfer the toner images onto the intermediate transfer belt. The plurality of transfer members includes a first transfer member facing a black image bearing member bearing a black toner image, and the second transfer members facing color image bearing members bearing the color toner images. The position adjusters includes a first position adjuster and a second position adjuster, to adjust the position of the intermediate transfer belt at a plurality of positions relative to the image bearing members. The first position adjuster adjusts the position of the intermediate transfer belt relative to the image bearing member for black, and the second position adjuster adjusts the position of the intermediate transfer belt relative to the color image bearing members. The plurality of positions includes a contact state in which the intermediate transfer belt having a predetermined tension contacts the image bearing member for black, a first separation state in which the intermediate transfer belt having a predetermined tension separates from the image bearing member for black, and a second separation state in which the intermediate transfer belt separates further away from the image bearing member for black than in the first separation position.

In yet another illustrative embodiment of the present invention, an image forming apparatus includes at least one image bearing member to bear a latent image on a surface thereof, a latent image forming device to form the latent image on the image bearing member, at least one developing device to develop the latent image formed on the image bearing member using toner to form visible image, and the transfer device.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
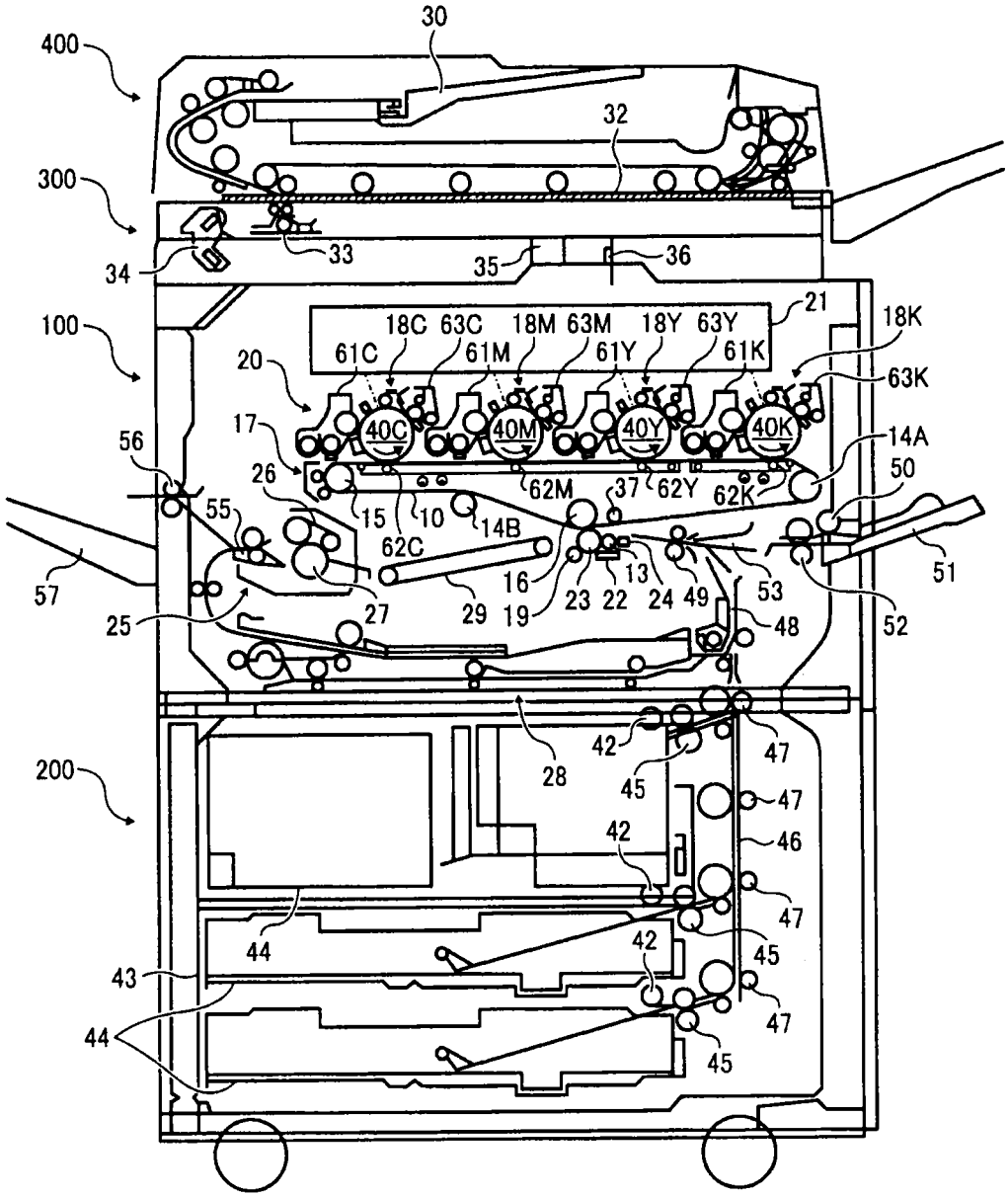
FIG. 1 is a schematic diagram illustrating a copier as an example of the image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating a copier as an example of the image forming apparatus. The image forming apparatus includes a copier main body 100, a sheet feeder 200, a scanner 300, and an automatic document feeder (hereinafter referred to as ADF) 400. The copier main body 100 is disposed on the sheet feeder 200. The scanner 300 is disposed on the copier main body 100.

The copier main body 100 includes a tandem image forming unit 20. The tandem image forming unit 20 includes image forming stations 18C, 18M, 18Y, and 18K arranged next to each other. The image forming stations 18C, 18M, 18Y, and 18K includes photoreceptor drums 40C, 40M, 40Y, and 40K each serving as a latent image bearing member, for toners of cyan, magenta, yellow, and black, respectively. Devices for performing electrophotographic process such as a charger, a developing device, and a cleaner, are disposed around each of the photoreceptor drums 40C, 40M, 40Y, and 40K.

It is to be noted that reference characters C, M, Y, and K denote colors cyan, magenta, yellow, and black, respectively. To simplify the description, the reference characters C, M, Y, and K indicating colors are omitted herein, when discrimination therebetween is not required.

The image forming stations 18C, 18M, 18Y, and 18K include developing devices 61C, 61M, 61Y, and 61K, respectively. The developing devices 61C, 61M, 61Y, and 61K store developing agents including toners of cyan, magenta, yellow, and black, respectively. Each of the developing devices 61 includes a developer bearing member for bearing and conveying the respective developing agent to a predetermined position and is supplied with an alternating electric field at a position opposite the photoreceptor drum 40, thereby developing the latent image formed on the photoreceptor drum 40 into a visible image, also known as a toner image.

When supplied with the alternating electric field, the developing agent is activated so that a distribution of an amount of toner charge is made narrower, thereby enhancing developability.

The developing device 61 and the photoreceptor drum 40 can be held integrally, thereby forming an integrated process cartridge that is detachable from the image forming apparatus. In addition, the process cartridge can include the charger and the cleaner.

In FIG. 1, the copier main body 100 includes an exposure device 21 substantially above the tandem image forming unit 20. Based on image information, the exposure device 21 illuminates the photoreceptor drum 40 with laser beam or LED light to form a latent image thereon.

An intermediate transfer belt 10 is disposed substantially at the bottom of the photoreceptor drums 40 of the tandem image forming unit 20. The intermediate transfer belt 10 is an endless looped belt and faces the photoreceptor drums 40.

The intermediate transfer belt 10 is supported by a plurality of support rollers 14A, 14B, 15, and 16.

Primary transfer devices 62C, 62M, 62Y, and 62K are each disposed facing a respective one of photoreceptor drums 40C, 40M, 40Y, and 40K through the intermediate transfer belt 10, thereby defining a nip therebetween. The primary transfer devices 62C through 62K transfer primarily the toner images formed on the photoreceptor drums 40C through 40K onto the intermediate transfer belt 10.

The intermediate transfer belt 10 is provided with a cleaning device 17 that removes toner remaining on the surface of the intermediate transfer belt 10. The cleaning device 17 includes a cleaning blade made of, for example, a fur brush or a urethane rubber, which contacts the intermediate transfer belt 10 to remove the residual toner therefrom.

Substantially below the intermediate transfer belt 10, a secondary transfer device is disposed. The secondary transfer device transfers a composite toner image consisting of overlapped toner images of different colors formed on the surface of the intermediate transfer belt 10 onto a recording medium conveyed from a sheet feed cassette 44 of the sheet feeder 200.

As will be described in detail with reference to FIG. 2, the secondary transfer device includes a secondary transfer roller 23 serving as a transfer member, and a support plate, not illustrated, that movably supports the secondary transfer roller 23 relative to the intermediate transfer belt 10. The support plate is rotatable about a shaft, not illustrated, thereby enabling the secondary transfer roller 23 to contact and separate from the intermediate transfer belt 10.

In the secondary transfer device, the secondary transfer roller 23 is pressed against the support roller 16 serving also as a back up roller so as to transfer the composite toner image from the intermediate transfer belt 10 to the recording medium.

A fixing device 25 is disposed substantially near the secondary transfer device and fixes the image on the recording medium. The fixing device 25 includes an endless-looped fixing belt 26 and a pressure roller 27 pressed against the fixing belt 26. Substantially below the secondary transfer device and the fixing device 25 is provided a sheet reversing device that reverses the recording medium to form an image on both sides of the recording medium.

With reference to FIG. 1, a description is now provided of operation of the image forming apparatus. An original document (hereinafter referred to as original) is placed on a document table 30 of the ADF 400 or on a contact glass 32 of the scanner 300 by opening the ADF 400. After the original is placed on the contact glass 32, the ADF 400 is closed. When a start button, not illustrated, is pressed, the original on the document table 30 of the ADF 400 is conveyed onto the contact glass 32. When the original is placed on the contact glass 32, the scanner 300 is activated, and a first carriage 33 and a second carriage 34 start to move. A light source of the first carriage 33 projects light against the original, receives light reflected on the original, and then reflects the light against the second carriage 34. The reflected light is then reflected by a mirror of the second carriage 34 against a read sensor 36 through an imaging lens 35, thereby enabling the read sensor 36 to read the original.

Turning on the power of the image forming apparatus causes a drive motor, not illustrated, to operate, thereby driving one of the support rollers 14A, 15, and 16. Other two support rollers follow rotation of the support roller driven by the drive motor. Accordingly, the intermediate transfer belt 10 is rotated.

Figure 2:
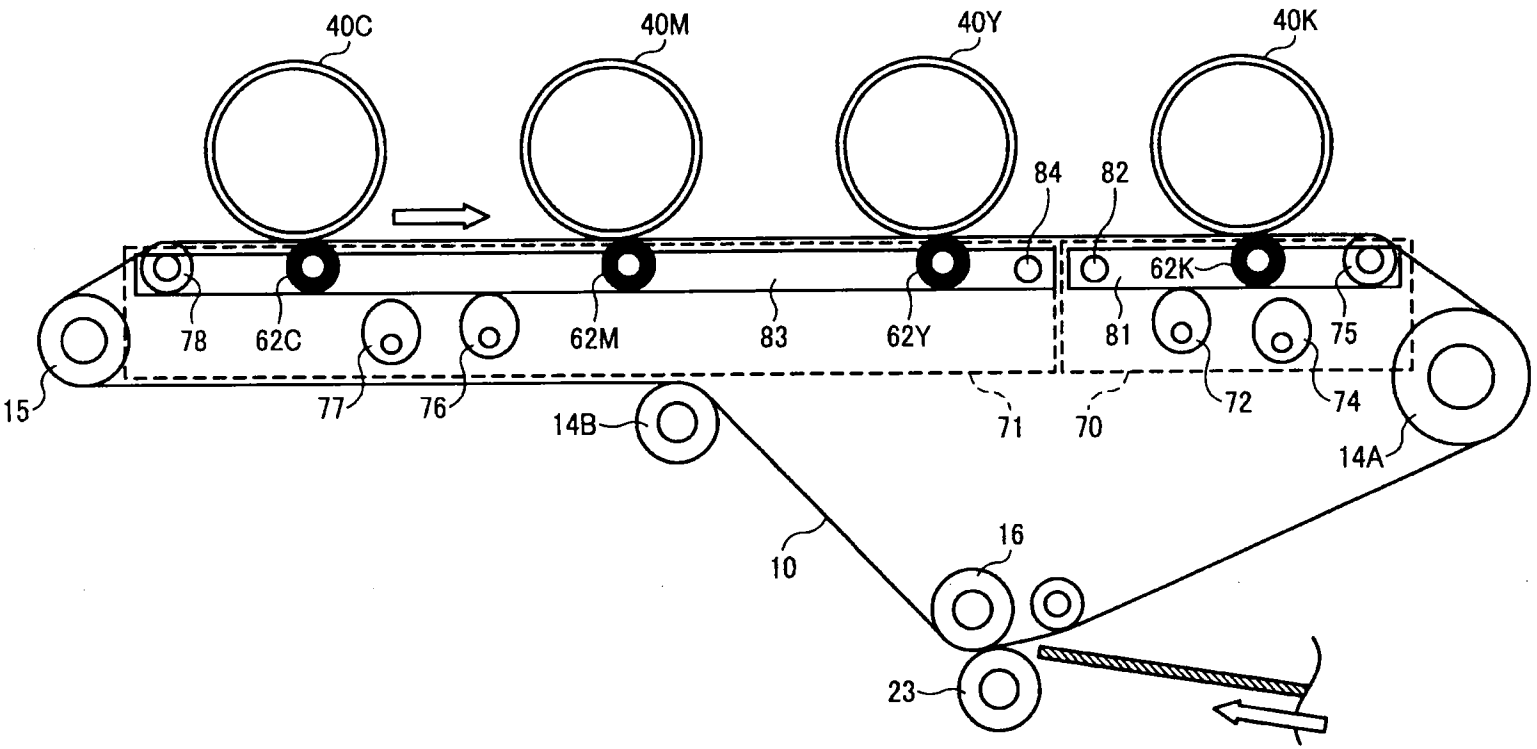
FIG. 2 is an enlarged view of a transfer unit of the image forming apparatus of FIG. 1 according to the illustrative embodiment of the present invention.

As illustrated in FIG. 2, the intermediate transfer belt 10 is laid also on a support roller 14B in addition to the support rollers 14A, 15, and 16. The support roller 14B is disposed on an outer circumference side of the intermediate transfer belt 10, thereby exerting tension against the belt surface.

When the intermediate transfer belt 10 rotates, the charger of each image forming station 18 charges the respective photoreceptor drum 40 uniformly. Subsequently, in accordance with image information read by the scanner 300, the exposure device 21 projects writing light L of a laser beam, an LED, or the like, against the charged photoreceptor drum 40, thereby forming an electrostatic latent image thereon.

The developing device 61 supplies a respective color of toner to the photoreceptor drum 40 on which the electrostatic latent image is formed so as to transform the electrostatic latent image into a visible image, also known as a toner image. A single-color toner image is formed on each of the photoreceptor drums 40 for black, yellow, magenta, and cyan.

The single-color toner images on the photoreceptor drums 40C through 40K are sequentially and overlappingly transferred onto the intermediate transfer belt 10 by the primary transfer devices 62C trough 62K, forming a composite color image on the intermediate transfer belt 10.

After the toner images are transferred from the photoreceptor drums 40 onto the intermediate transfer belt 10, residual toner remaining on the surface of the photoreceptor drums 40 is removed by a photoreceptor cleaning device. Further, charge of the photoreceptor 40 is neutralized by the charge neutralizing device in preparation for the subsequent image forming cycle.

When the start button is pressed, one of sheet feed rollers 42 in the sheet feeder 200 is selected to rotate, picking up and sending a recording medium from a stack of recording media sheets stored in one of the sheet feed cassette 44 of a paper bank 43. A separation roller 45 separates the recording medium one sheet at a time so that a sheet of the recording medium is conveyed to a sheet feed path 46. Transport rollers 47 guide the recording medium to a sheet feed path 48 in the copier main body 100. As the recording medium comes into contact with a pair of registration rollers 49 in the copier main body, the recording medium stops.

In a case of manual sheet feeding, a sheet feed roller 50 is rotated to convey the recording medium on a manual sheet feed tray 51. A separation roller 52 separates the recording medium from a stack of recording media sheets and feeds it to a manual sheet feed path 53 until the recording medium comes into contact with the registration rollers 49.

The registration rollers 49 start to rotate in appropriate timing such that the recording medium is aligned with the composite color toner image on the intermediate transfer belt 10, and send the recording medium between the intermediate transfer belt 10 and the secondary transfer device where the composite color toner image is transferred onto the recording medium.

After passing the secondary transfer roller 23, the recording medium bearing the unfixed toner image is conveyed to the fixing device 25 disposed at the downstream side in the conveyance direction of the recording medium. In the fixing device 25, heat and pressure is applied on the recording medium, thereby fixing the toner image on the recording medium.

After the fixing process, a switching pawl 55 switches the direction of conveyance, and a discharge roller 56 discharges the recording medium onto a sheet discharge tray 57, or the switching pawl 55 switches the direction of conveyance to the sheet reversing device where the recording medium is reversed and guided again to the transfer position at which an image is formed on the back of the recording medium. Subsequently, the sheet discharge roller 56 discharges the recording medium onto the sheet discharge tray 57. At this time, the residual toner remaining on the intermediate transfer belt 10 after the image transfer process is removed by the cleaning device 17 in preparation for a subsequent image forming cycle in the tandem image forming unit 20.

Referring now to FIG. 2, there is provided an enlarged view of the transfer unit of the image forming apparatus according to the illustrative embodiment of the present invention.

As described above, the transfer unit includes the transfer roller 62K serving as a transfer member which transfers the toner image of black formed on the photoreceptor drum 40K for monochrome imaging onto the intermediate transfer belt 10, and transfer rollers 62C, 62M, and 62Y serving as transfer members which transfer toner images of yellow, magenta, and cyan formed on the respective photoreceptor drums 40C, 40M, and 40Y for color imaging onto the intermediate transfer belt 10. The transfer unit also includes a position adjuster 70 which controls contact and separation of the transfer roller 62K relative to the photoreceptor drum 40K, and a position adjuster 71 which control contact and separation of the transfer rollers 62C, 62M, and 62Y, respectively.

The position adjuster 70 consists of a support member 81, a first cam 72, and a second cam 74. The support member 81 is a plate member or a rectangular frame that rotatably supports the transfer roller 62K and a downstream backup roller 75 disposed at the downstream side in the sheet conveyance direction. The support member 81 is rotatable about a rotary shaft 82 disposed upstream from the transfer roller 62K in the traveling direction of the belt and inside the inner loop of the intermediate transfer belt 10.

Since the transfer roller 62K and the downstream backup roller 75 are disposed between the support roller 14A and the support roller 15, the positions of which are fixed relative to the intermediate transfer belt 10, the support member 81 can adjust the position of the transfer roller 62K and the downstream backup roller 75 with ease. More specifically, according to the illustrative embodiment, the transfer roller 62K and the downstream backup roller 75 move in conjunction with rotation of the support member 81 about the rotary shaft 82, thereby enabling adjustment of the intermediate transfer belt 10 relative to the photoreceptor drum 40K.

The downstream backup roller 75 is disposed downstream from the transfer roller 62K in the traveling direction of the intermediate transfer belt 10, and equalizes a size of the nip at the primary transfer portion of each color.

As illustrated in FIG. 2, the first cam 72 and the second cam 74 are disposed substantially at the bottom of the support member 81. FIG. 2 illustrates the first cam 72 supporting the support member 81 at the top dead center of the first cam 72, and the intermediate transfer belt 10 contacting the photoreceptor drum 40K.

Rotation of the first cam 72 and the second cam 74 causes the support member 81 to rotate about the support shaft 82. In conjunction with rotation of the support member 81, the transfer roller 62K and the downstream backup roller 75 are moved.

By controlling stop positions for each of the first cam 72 and the second cam 74, two steps of rotation movement can be performed. Those two steps of rotation movement include, for example, a first separation state in which the intermediate transfer belt 10 in contact with the photoreceptor drum 40 separates from the photoreceptor drum 40K, and a second separation state in which an amount of the intermediate transfer belt 10 wound around the backup roller 75 is reduced so as to reduce the tension of the belt. The first and the second rotation steps are performed sequentially.

It is to be noted that the first cam 72 and the second cam 74 are arranged horizontally next to each other. However, the position of the second cam 74 is lower than that of the first cam 72 in a vertical direction, and the position of the top dead center of the second cam 74 is higher than the bottom dead center of the first cam 72.

With this configuration, when the intermediate transfer belt 10 is in contact with the photoreceptor drum 40K, the support member 81 is supported by the first cam 72 at the top dead center thereof. In the first separation state, the support member 81 is supported at the top dead center of the second cam 74. In the second separation state, the support member 81 is supported at the bottom dead center of either the first cam 72 or the second cam 74.

It is to be noted that when the intermediate transfer belt 10 and the photoreceptor drums 40C, 40M, and 40Y are in the contact state, that is, the intermediate transfer belt 10 contacts the photoreceptor drums 40C, 40M, and 40Y, the position the intermediate transfer belt 10, the transfer rollers 62C, 62M, and 62Y, and so forth is referred to as a "contact position". When the intermediate transfer belt 10 and the photoreceptor drums 40C, 40M, and 40Y are in the first separation state, the position of the intermediate transfer belt 10, the transfer rollers 62C, 62M, and 62Y, and so forth is referred to as a "first separation position". When the intermediate transfer belt 10 and the photoreceptor drums 40C, 40M, and 40Y are in the second separation state, the position of the intermediate transfer belt 10, the transfer rollers 62C, 62M, and 62Y, and so forth is referred to as a "second separation position".

Figure 3:
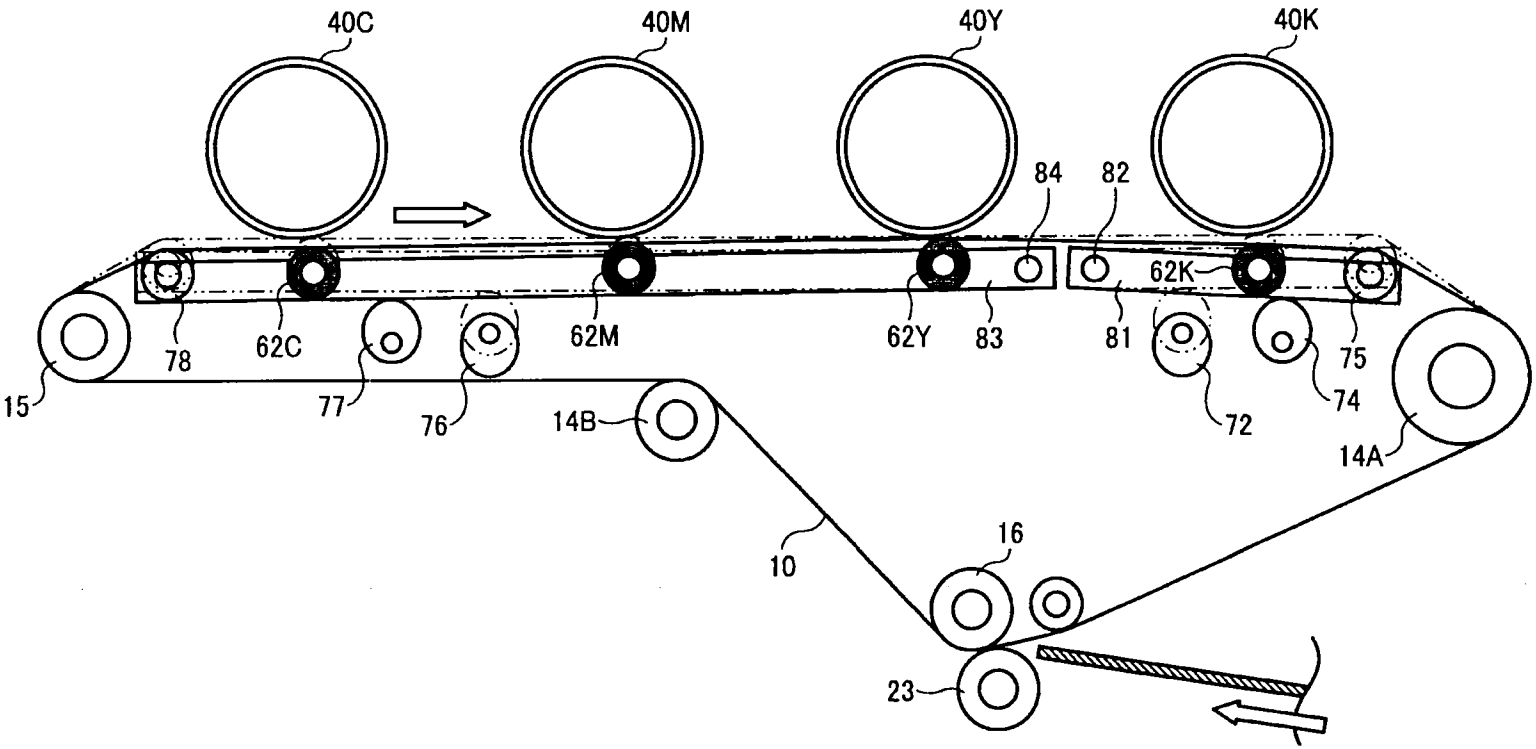
FIG. 3 is an enlarged view of the transfer unit in a first separation state according to an illustrative embodiment of the present invention.

Referring now to FIG. 3, there is provided an enlarged view of the transfer unit in the first separation state in which the intermediate transfer belt 10 is separated from the photoreceptor drum 40K for a monochrome image by moving the transfer roller 62K disposed opposite the photoreceptor drum 40K away from the photoreceptor drum 40K.

In order to move the transfer roller 62K from the contact position shown in FIG. 2 to the first separation position shown in FIG. 3, the first cam 72 at the top dead center is rotated by 180 degrees by the drive force of a driving device such as a motor or a solenoid, not illustrated, and stopped at the bottom dead center of the first cam 72. Subsequently, with rotation of the first cam 72, the support member 81 rotates in a clockwise direction about the rotary shaft 82 together with the transfer roller 62K and the downstream backup roller 75 due to the tension of the belt and its own weight. Then, the support member 81 contacts the second cam 74 at the top dead center of the second cam 74 before the first cam 72 reaches the bottom dead center thereof, thereby positioning the support member 81 in place.

Figure 4:
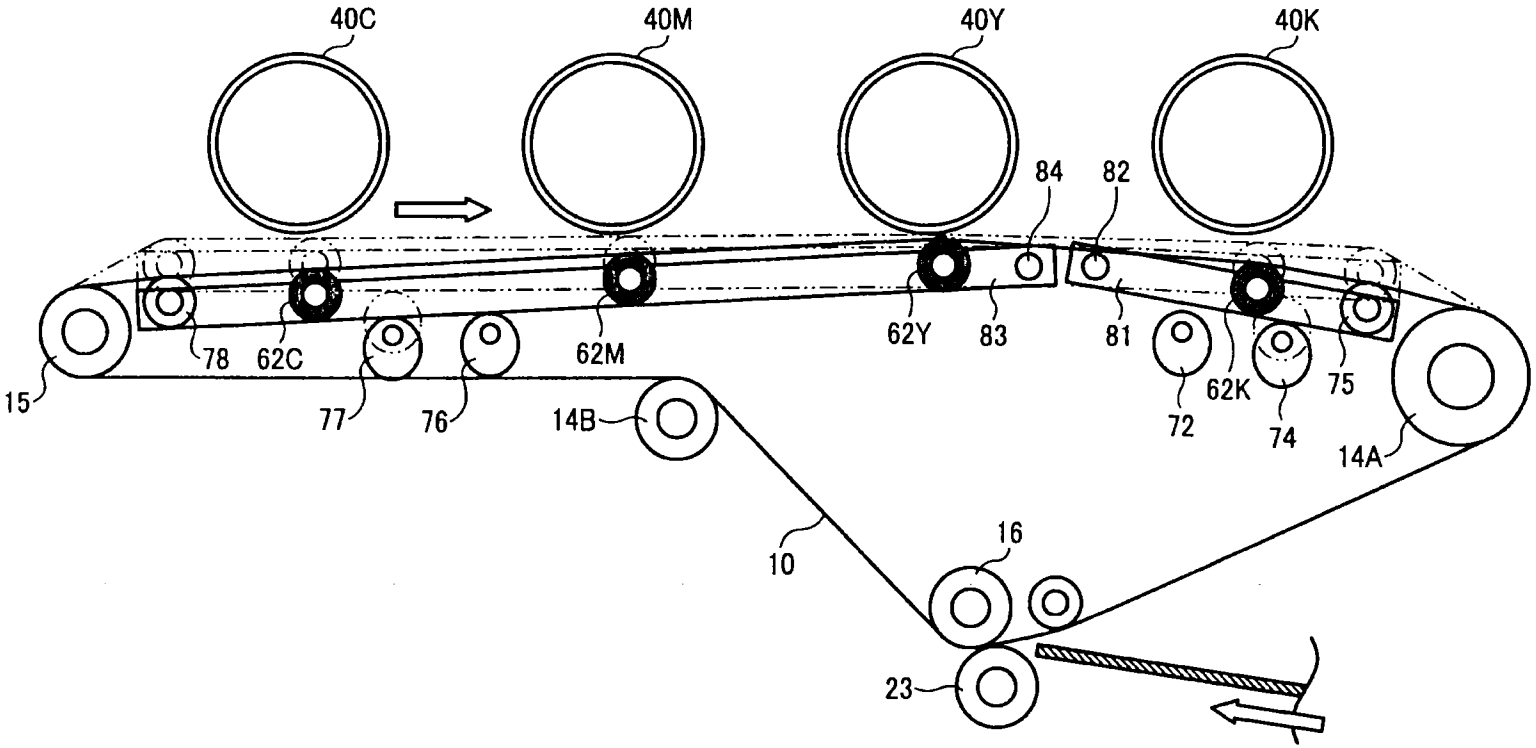
FIG. 4 is an enlarged view of the transfer unit in a second separation state according to an illustrative embodiment of the present invention.

Referring now to FIG. 4, there is provided an enlarged view of the transfer unit in the second separation state in which the transfer roller 62K continues to move, and the intermediate transfer belt 10 moves from the first separation position shown in FIG. 3 to the second separation position further away from the photoreceptor drum 40K. With reference to FIG. 4, a description is provided of the transfer roller 62K disposed opposite the photoreceptor drum 40K for forming a monochrome image.

In order to move the transfer roller 62K at the first separation position shown in FIG. 3 to the second separation position shown in FIG. 4, a lever, not illustrated, is manually moved, thereby rotating the second cam 74 by 180 degrees and stopping the second cam 74 at the bottom dead center thereof.

With rotation of the second cam 74, the support member 81 rotates about the rotary shaft 82 in the clockwise direction in FIG. 4 together with the transfer roller 62K and the downstream backup roller 75 due to the tension of the belt and its own weight. Accordingly, the support member 81 is positioned properly at the bottom dead center of the first cam 72. In other words, the support member 81 is positioned at the second separation position, causing the intermediate transfer belt 10 to move from the first separation position further away from the photoreceptor drum 40.

It is to be noted that the second separation position at which the support member 81 is supported is not limited to the bottom dead center of the first cam 72. Alternatively, the position of the support member 81 supported at the second separation position may be at the bottom dead center of the second cam 74.

Rotation of the first cam 72 enables the transfer roller 62K supported by the support member 81 to move, thereby enabling positional control between the contact position and the first separation position. Furthermore, rotation of the second cam 74 enables positional control between the first separation position and the second separation position. The downstream backup roller 75 at the downstream side can move with the support member 81 so that the position of the downstream backup roller 75 can be controlled at multiple positions including the contact position, the first separation position, and the second separation position.

Referring back to FIG. 2, a description is provided of the position adjuster 71. As illustrated in FIG. 2, the position adjuster 71 includes a support member 83, a first cam 76, and a second cam 77. The support member 83 is a plate member or a rectangular frame that rotatably supports the transfer rollers 62C, 62M, and 62Y and an upstream backup roller 78 disposed upstream in the sheet conveyance direction. The support member 83 is rotatable about a rotary shaft 84 disposed downstream from the transfer roller 62Y in the traveling direction of belt and inside the inner loop of the intermediate transfer belt 10.

Since the transfer rollers 62C, 62M, and 62Y, and the upstream backup roller 78 are disposed between the support rollers 14A and the support roller 15, the positions of which are fixed relative to the intermediate transfer belt 10, the support member 83 can adjust the position of the transfer rollers 62C, 62M, and 62Y, and the upstream backup roller 78 with ease. More specifically, according to the illustrative embodiment, the transfer rollers 62C, 62M, and 62Y, and the upstream backup roller 78 move in conjunction with rotation of the support member 83 about the rotary shaft 84, thereby enabling adjustment of the position of the intermediate transfer belt 10 relative to the photoreceptor drums 40C, 40M, and 40Y.

The upstream backup roller 78 is disposed upstream from the transfer roller 62C in the traveling direction of the intermediate transfer belt 10, and controls the size of the nip at the primary transfer portion such that a nip of the same size is provided at the primary transfer portion of each color.

As illustrated in FIG. 2, the first cam 76 and the second cam 77 are disposed substantially at the bottom of the support member 83. FIG. 2 illustrates the first cam 76 supporting the support member 83 at the top dead center of the first cam 76, and the intermediate transfer belt 10 in contact with the photoreceptor drums 40C, 40M, and 40Y.

Rotation of the first cam 76 and the second cam 77 causes the support member 83 to rotate about the support shaft 84. In conjunction with rotation of the support member 83, the transfer rollers 62C, 62M, and 62Y and the upstream backup roller 78 move.

By controlling stop positions of each of the first cam 76 and the second cam 77, two steps of rotation movement can be performed. These two steps of rotation movement include, for example, the first separation state in which the intermediate transfer belt 10 in contact with the photoreceptor drums 40C, 40M, and 40Y separates therefrom, and a second separation state in which an amount of the intermediate transfer belt 10 wound around the upstream backup roller 78 is reduced so as to reduce the tension of the intermediate transfer belt 10. The first and the second rotation steps are performed sequentially.

It is to be noted that the first cam 76 and the second cam 77 are arranged next to each other horizontally. However, the position of the second cam 77 is lower than that of the first cam 76 in a vertical direction, and the position of the top dead center of the second cam 77 is higher than the bottom dead center of the first cam 76.

With this configuration, when the intermediate transfer belt 10 is in contact with the photoreceptor drums 40C, 40M, and 40Y, the support member 83 is supported by the first cam 76 at the top dead center thereof. In the first separation state, the support member 83 is supported at the top dead center of the second cam 77. In the second separation state, the support member 83 is supported at the bottom dead center of either the first cam 76 or the second cam 77.

It is to be noted that when the intermediate transfer belt 10 and the photoreceptor drums 40C, 40M, and 40Y are in the contact state, that is, the intermediate transfer belt 10 contacts the photoreceptor drums 40C, 40M, and 40Y, the position the intermediate transfer belt 10, the transfer rollers 62C, 62M, and 62Y, and so forth is referred to as a "contact position". When the intermediate transfer belt 10 and the photoreceptor drums 40C, 40M, and 40Y are in the first separation state, the position of the intermediate transfer belt 10, the transfer rollers 62C, 62M, and 62Y, and so forth is referred to as a "first separation position". When the intermediate transfer belt 10 and the photoreceptor drums 40C, 40M, and 40Y are in the second separation state, the position of the intermediate transfer belt 10, the transfer rollers 62C, 62M, and 62Y, and so forth is referred to as a "second separation position".

In order to move the transfer rollers 62C, 62M, and 62Y from the contact position shown in FIG. 2 to the first separation position as shown in FIG. 3, the first cam 76 at the top dead center is rotated by 180 degrees by the drive force of a driving device such as a motor or a solenoid, not illustrated, and stopped at the bottom dead center thereof. Subsequently, with rotation of the first cam 76, the support member 83 rotates about the rotary shaft 84 in a counterclockwise direction together with the transfer rollers 62C, 62M, and 62Y and the upstream backup roller 78 due to the tension of the belt and its own weight. Then, the support member 83 contacts the second cam 77 at the top dead center before the first cam 76 reaches the bottom dead center thereof, thereby positioning the support member 83 in place.

In order to move the transfer rollers 62C, 62M, and 62Y from the first separation position shown in FIG. 3 to the second separation position shown in FIG. 4, a lever, not illustrated, is manually moved, thereby rotating the second cam 77 by 180 degrees and stopping the second cam 77 at the bottom dead center thereof. With rotation of the second cam 77, the support member 83 rotates about the rotary shaft 84 in the counterclockwise direction in FIG. 4 together with the transfer rollers 62C, 62M, and 62Y, and the upstream backup roller 78 due to the tension of the belt and its own weight. Accordingly, the support member 83 is positioned properly at the bottom dead center of the first cam 76.

At the second separation position, the intermediate transfer belt 10 is moved from the first separation position further away from the photoreceptor drums 40C, 40M, and 40Y.

It is to be noted that the second separation position at which the support member 83 is supported is not limited to the bottom dead center of the first cam 76. Alternatively, the second separation position at which the support member 83 is supported may be at the bottom dead center of the second cam 77.

Rotation of the first cam 76 enables the transfer rollers 62C, 62M, and 62Y supported by the support member 83 to move between the contact position and the first separation position. Furthermore, rotation of the second cam 77 enables positional control between the first separation position and the second separation position. The upstream backup roller 78 at the upstream side can move together with the support member 83, allowing the position of the upstream backup roller 78 to be controlled at multiple positions including the contact position, the first separation position, and the second separation position.

According to the illustrative embodiment, in the contact state, two backup rollers 75 and 78, the transfer roller 62K for black, and the transfer rollers 62C, 62M, and 62Y contact the intermediate transfer belt 10 substantially on the same plane.

When printing a color image using all photoreceptor drums 40C, 40M, 40Y, and 40K (full color printing) and the transfer rollers 62C, 62M, and 62Y, two backup rollers 73 and 78 can provide the same size transfer nip for each color.

In particular, as illustrated in FIG. 2, the upstream back up roller 78 prevents the intermediate transfer belt 10 from tilting toward the support roller 15 substantially at the upstream side of the photoreceptor drum 40C. Similarly, the downstream backup roller 75 prevents the intermediate transfer belt 10 from tilting toward the support roller 14A substantially at the downstream side of the photoreceptor drum 40K.

According to the illustrative embodiment, the rotary shaft 82 and the rotary shaft 84 are disposed between the transfer roller 62K for black and the transfer rollers 62C, 62M, and 62Y for color image. With this configuration, either the monochrome (black) image forming section (photoreceptor drum 40K and the transfer roller 62K) or the color image forming section (photoreceptor drums 40C, 40M, 40Y) can be easily separated.

Figure 5:
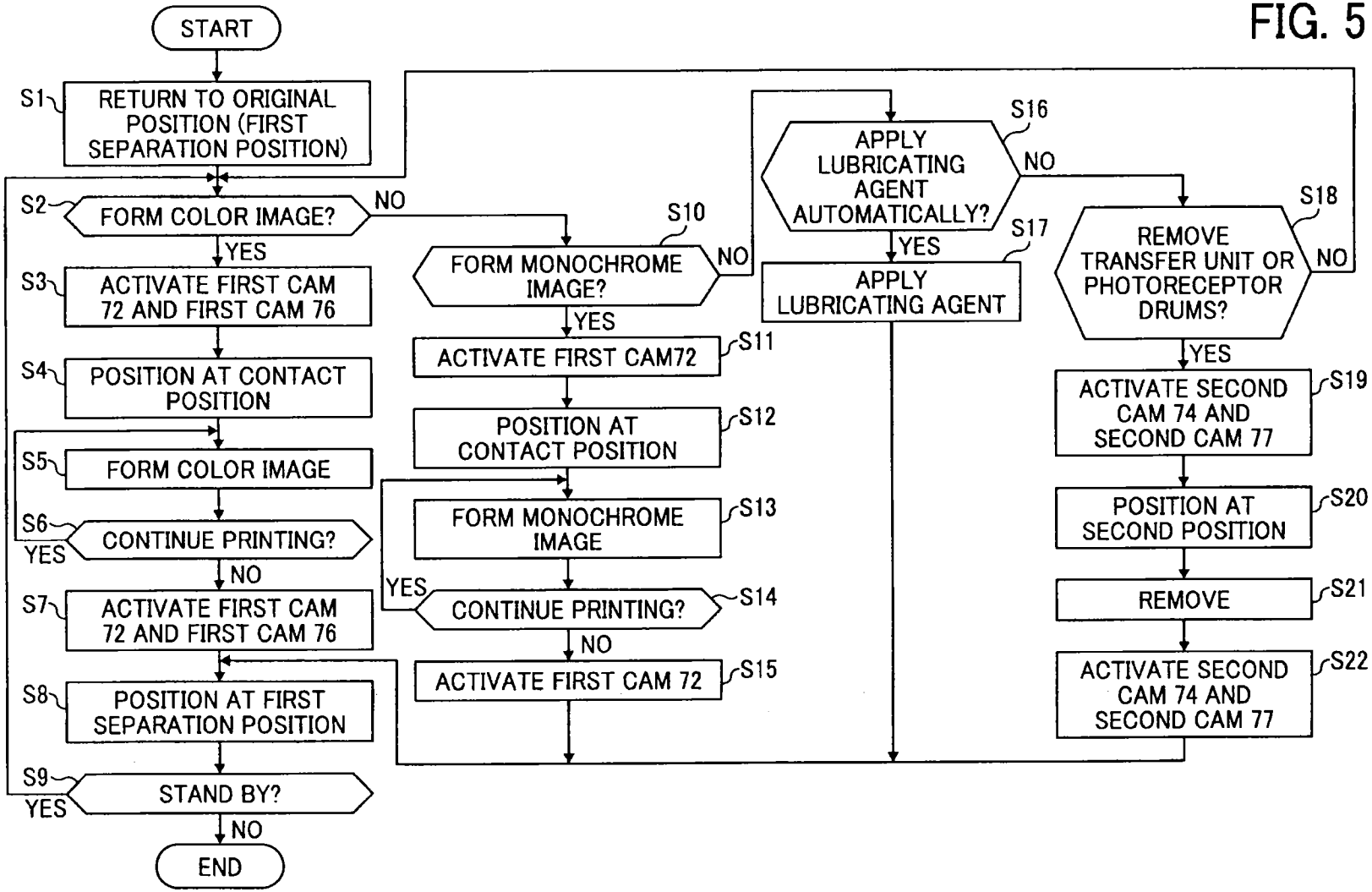
FIG. 5 is a flowchart showing steps in an exemplary procedure performed by the transfer unit according to an illustrative embodiment of the present invention.

With reference to FIG. 5, a description is provided of operation of the transfer unit. FIG. 5 is a flowchart showing steps in an exemplary procedure performed by the transfer unit.

At step S1, in the copier main body 100, the first cam 72 and the first cam 76 move to the bottom dead center, returning to origin at the first separation position, and wait. When the image forming apparatus receives color image print information at step S2, the first cam 72 is rotated by the drive force of the driving mechanism of the position adjuster 70, thereby positioning the transfer roller 62K and the downstream backup roller 75 at the contact position. As the first cam 76 is rotated by the drive force of the drive mechanism of the position adjuster 71, the plurality of the transfer rollers 62C, 62M, and 62Y as well as the upstream backup roller 78 are positioned at the contact position at steps S3 and S4. At this contact position, image forming processing for a color image is performed at step S5.

When printing continuously (Yes, at step S6), the color image forming processing is continuously performed. On the other hand, if the color image processing is finished (No, at step S6), the first cam 72 is rotated by the drive force of the driving device of the position adjuster 70 before stopping rotation of the intermediate transfer belt 10 and the photoreceptor drums 40C, 40M, and 40Y, thereby positioning the transfer roller 62K and the downstream backup roller 75 at the first separation position (at step S8). At the same time, the first cam 76 is rotated by the drive force of the driving device of the position adjuster 71, thereby positioning the transfer rollers 62C, 62M, and 62Y, and the upstream backup roller 78 at the first separation position at step S8.

Subsequently, the operation is in a standby state until the next image information is received (Yes, at step S9), or the operation is completed (No, at step S9).

By contrast, if the image forming apparatus receives monochrome image print information (Yes, at step S10), the first cam 72 is rotated by the drive force of the driving device of the position adjuster 70, thereby positioning the transfer roller 62K and the downstream backup roller 75 at the contact position (steps S11 and S12). At this time, the position adjuster 71 does not operate while the transfer rollers 62C, 62M, and 62Y, and the upstream backup roller 78 remain positioned at the first separation position, and the monochrome image forming operation is performed.

At step S13, the monochrome image is formed at the contact position. When printing continuously, the monochrome image is formed continuously (Yes, at step S14). Upon completion of the monochrome image forming operation (No, at step S14), the first cam 72 is rotated by the driving device of the position adjuster 70 (at step S15), thereby positioning the transfer roller 62K and the downstream backup roller 75 at the first separation position (at step S8).

When applying automatically the lubricating agent stored in the cleaning device 17 (shown in FIG. 1) onto the intermediate transfer belt 10, that is, when a lubricating agent application mode is selected (Yes, at step S16), the intermediate transfer belt 10 is driven and the lubricating agent is applied thereon while the position adjuster 70 and the position adjuster 71 keep the position of the transfer rollers 62C, 62M, 62Y, and 62K at the first separation position at step S17.

At the first separation position, the transfer unit and/or the photoreceptor drums are not to be detached from the image forming apparatus. Detachability of the transfer unit and/or the photoreceptor drums is taken into account at the second separation position. Therefore, the transfer rollers 62C, 62M, 62Y, and 62K and the photoreceptor drums 40C, 40M, 40Y, and 40K at the first separation position are configured to be in proximity to each other, thereby suppressing fluctuation of the traveling path of the intermediate transfer belt 10 when the intermediate transfer belt 10 contacts or separates from the photoreceptor drums 40C, 40M, 40Y, and 40K.

With this configuration, fluctuation of the tension of the intermediate transfer belt 10 is suppressed, if not prevented entirely, thereby applying a desired tension to the intermediate transfer belt 10 and controlling drift of the intermediate transfer belt 10.

Furthermore, in a case in which the image forming apparatus receives image information containing both a monochrome image and a color image, image distortion and color drift due to fluctuation of the traveling speed of the intermediate transfer belt 10 upon switching printing modes between the monochrome printing mode and the color printing mode can be prevented. Still further, displacement in the main scanning direction, loosening, and/or slippage of the intermediate transfer belt 10 can be prevented.

It is to be noted that it is preferable that the intermediate transfer belt 10, the transfer rollers 62C, 62M, 62Y, and 62K, and so forth be at the first separation position during the standby mode, that is, from the completion of one printing operation until the next printing operation. With this configuration, the intermediate transfer belt 10 is prevented from contacting undesirably the photoreceptor drums 40C, 40M, 40Y, and 40K, thus preventing abrasion and damage.

It is to be noted that fluctuation of the tension of the intermediate transfer belt 10 at the first separation state is smaller than that of at the contact state. For this reason, the tension of the belt does not need to be increased in the next print operation, which reduces stress on the transfer unit caused by fluctuation of the belt tension.

When replacing parts such as the photoreceptor drums 40C, 40M, 40Y, and 40K, the transfer rollers 62C, 62M, 62Y, and 62K, and the intermediate transfer belt 10, it is necessary to remove the transfer unit (the transfer rollers 62C, 62M, 62Y, and 62K, and the intermediate transfer belt 10) or the photoreceptor drums 40C, 40M, 40Y, and 40K from the image forming apparatus (Yes, at step S18). In such a case, the lever, not illustrated, provided to the position adjuster 70, is manually operated so as to rotate the second cam 74 and move the transfer roller 62K and the downstream backup roller 75 from the first separation position to the second separation position (at steps S19 and S20).

When operating manually the lever provided to the position adjuster 71, the second cam 77 rotates and the plurality of the transfer rollers 62C, 62M, and 62Y and the upstream backup roller 78 move from the first separation position to the second separation position (at steps S19 and S20). At the second separation position, the intermediate transfer belt 10 and so forth are detached from the image forming apparatus (at step S21).

According to the illustrative embodiment, at the second separation position, the intermediate transfer belt 10 can separate from the plurality of the photoreceptor drums 40C, 40M, 40Y, and 40K by a relatively large amount without taking fluctuation of the tension of the belt into consideration. This is because at the second separation position the intermediate transfer belt 10 does not rotate and thus the tension of the belt does not need to be taken into account.

Accordingly, at the second separation position, the intermediate transfer belt 10 can separate from the photoreceptor drums 40 by a large amount, thereby enhancing detachability of the transfer unit including the intermediate transfer belt 10, the support rollers 14A, 14*b*, 15, and 16, and the photoreceptor drums 40.

After removal, the second cam 74 and the second cam 77 are rotated by manually operating the levers, not illustrated, to move the plurality of the transfer rollers 62 and the backup rollers 75 and 78 to the first separation position (at steps S22 and S8).

As described above, the transfer unit according to the illustrative embodiment is equipped with the position adjuster 70 and the position adjuster 71. The position adjuster 70 moves and controls the transfer roller 62K and the downstream backup roller 75 at a plurality of positions: the contact position, the first separation position, and the second separation position. The position adjuster 71 moves and controls the plurality of transfer rollers 62C, 62M, and 62Y, and the upstream backup roller 78 at different positions: the contact position, the first separation position, and the second separation position.

The driving device of the position adjuster 70 enables the transfer roller 62K and the downstream backup roller 75 to move from the contact position to the first separation position. The transfer roller 62K and the downstream backup roller 75 are moved to the second separation position by manually controlling the lever of the position adjuster 70.

The driving device of the position adjuster 71 enables the plurality of transfer rollers 62C, 62M, and 62Y, and the upstream backup roller 78 to move from the contact position to the first separation position. The transfer rollers 62C, 62M, and 62Y, and the upstream backup roller 78 are moved to the second separation position by manually controlling the lever of the position adjuster 71.

The transfer rollers 62C, 62M, 62Y, and 62K, and the backup rollers 75 and 78 are in the contact state and the first separation state during printing and the standby mode. Considering a typical use of the image forming apparatus, that is, printing and the standby mode are repeated while the power of the image forming apparatus is on, transition from the contact state to the first separation state or visa versa is preferably performed automatically using a driving device.

By contrast, the transfer rollers 62C, 62M, 62Y, and 62K, and the backup rollers 75 and 78 are in the second separation state when the transfer unit and/or the photoreceptor drums 40 need to be removed, for example when the transfer belt and/or the photoreceptor drums are subjected to maintenance. When compared with the frequency of position adjustment between the contact state and the first contact state, the frequency of the second separation state is significantly less. Thus, rather than using a driving device, manual control is preferable in terms of manufacturing cost.

According to the illustrative embodiment, the traveling distance of the transfer rollers 62C, 62M, 62Y, and 62K, the downstream backup roller 75, and the upstream backup roller 78 is configured relatively short from the contact state to the first separation state. The amount of the intermediate transfer belt 10 wound around the downstream backup roller 75 and the upstream backup roller 78 is less than that of around the support rollers 14A and 15. Further, the force due to the belt tension is also less. Therefore, the parts such as the first cam 72 and the second cam 76 that enable contact and separation receive less stress. It is also possible to minimize fluctuation of the belt tension when switching from the contact state to the first separation state.

By contrast, the traveling distance of the transfer rollers 62C, 62M, 62Y, and 62K, the downstream backup roller 75, and the upstream backup roller 78 is configured relatively long from the first separation state to the second separation state.

In the second separation state, it is not necessary to maintain the belt tension. Therefore, the intermediate transfer belt 10 can separate from the photoreceptor drums 40 by a relatively large amount, thereby facilitating detachability of the photoreceptor drums 40 and the intermediate transfer belt 10.

As can be understood from FIG. 4, according to the illustrative embodiment, the amount of the intermediate transfer belt 10 wound around the downstream backup roller 75 and the upstream backup roller 78 is reduced in the second separation state, thereby reducing significantly the tension of the intermediate transfer belt 10.

With this configuration, after the transfer unit including the intermediate transfer belt 10, the transfer rollers 62, the support rollers 14A, 14B, 15, and 16, the backup rollers 75 and 78 are separated from the photoreceptor drums 40C, 40M, 40Y, and 40K, the intermediate transfer belt 10 can be removed from each of the rollers with ease.

According to the illustrative embodiment, the intermediate transfer belt 10 is detachable from the rollers after separating the support roller 14B which supports the intermediate transfer belt 10 from the outer circumference thereof. In the second separation state, the tension of the intermediate transfer belt 10 has already been reduced significantly so that it is easy to separate the support roller 14B from the intermediate transfer belt 10 either manually or automatically.

After the support roller 14B is separated from the intermediate transfer belt 10, the loosened intermediate transfer belt 10 is separated from other support rollers. Accordingly, the intermediate transfer belt 10 is completely removed. In a case of installation of the intermediate transfer belt 10, the intermediate transfer belt 10 is installed the image forming apparatus in reverse.

Figure 6:
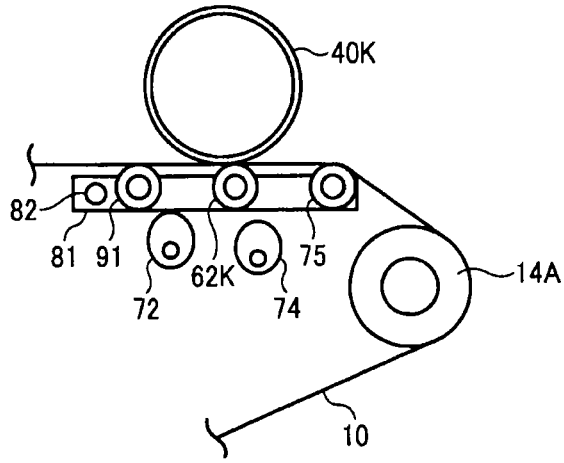
FIGS. 6(*a*) through 6(*c*) are partially enlarged schematic diagrams illustrating the transfer unit in different states according to another illustrative embodiment of the present invention.
Figure 6:
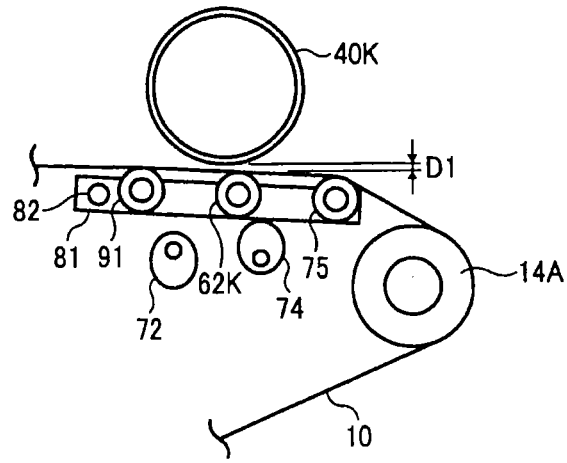
Figure 6:
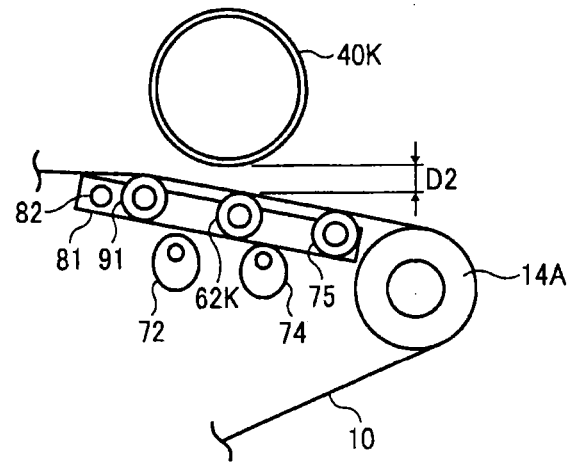

Referring now to FIGS. 6(*a*) through 6(*c*), there are provided partially enlarged schematic diagrams illustrating the intermediate transfer device according to another illustrative embodiment of the present invention. FIG. 6(*a*) illustrates the transfer device in the contact state. FIG. 6(*b*) illustrates the transfer device in the first separation state. FIG. 6(*c*) illustrates the transfer device in the second separation state.

According to the present embodiment, an auxiliary roller 91 is provided upstream from the transfer roller 62K in the traveling direction of the intermediate transfer belt 10, which is different from the foregoing embodiments. The auxiliary roller 91 is disposed between the rotary shaft 82 and the transfer roller 62K, but relatively toward the rotary shaft side, and rotatably supported by the support member 81.

In the contact state shown in FIG. 6(*a*), the intermediate transfer belt 10 is in contact with the auxiliary roller 91 and the transfer roller 62K without winding therearound.

By contrast, in the first and the second separation states shown in FIGS. 6(*b*) and 6(*c*), respectively, the intermediate transfer belt 10 is wound around the auxiliary roller 91.

According to the present embodiment, the auxiliary roller 91 supports the intermediate transfer belt 10 immediately above the rotary shaft 82, thereby preventing the rotary shaft 82 from contacting the intermediate transfer belt 10. The auxiliary roller 91 provides greater flexibility in the arrangement of the rotary shaft 82 and other rollers.

Furthermore, the transfer roller 62K is disposed between the auxiliary roller 91 and the downstream backup roller 75. The transfer roller 62K, the auxiliary roller 91, and the downstream backup roller 75 are arranged linearly and move together while maintaining the relative positions of the transfer roller 62K, the auxiliary roller 91, and the downstream backup roller 75, as illustrated in FIGS. 6(*a*) through 6(*c*). In this configuration, the intermediate transfer belt 10 is prevented from being undesirably wound around the transfer roller 62K, preventing stress on the transfer roller 62K which contributes to the transfer accuracy, thus preventing deformation or damage to the support shaft of the transfer roller 62K.

With reference to FIGS. 6(*a*) through 6(*c*), a description is provided of examples of a distance between the photoreceptor drum 40K and the transfer roller 62K.

In the contact state shown in FIG. 6(*a*), the distance between the rotary shaft 82 and the downstream backup roller 75 is, for example, 200 mm, and the distance between the rotary shaft 82 and the transfer roller 62K is, for example, 130 mm. In this state, the first cam 72 is rotated by 180 degrees so as to move the contact position between the support member 81 and the first cam 72 substantially vertically downward, causing the support member 81 to contact the top dead center of the second cam 74. This state corresponds to the first separation state illustrated in FIG. 6(*b*). In the first separation state, the distance D1 between the photoreceptor drum 40K and the transfer roller 62K is, for example, 4 mm.

Further, the second cam 74 in the first separation state is rotated by 180 degrees, thereby moving the contact position between the support member 81 and the second cam 74 substantially vertically downward, causing the support member 81 to contact the bottom dead center of the first cam 72 (shown in FIG. 6(*c*)). This is the second separation state in which the amount of separation is greater than that of the first separation state. The distance D2 between the photoreceptor drum 40K and the transfer roller 62K in this state is, for example, 17 mm which is greater than the first separation state. The amount of distance between the photoreceptor drum 40K and the transfer roller 62K in the second separation state is greater than the first separation state.

The tension and the amount of the intermediate transfer belt 10 wound around the downstream backup roller 75 is the greatest in the contact state. The tension and the amount of the intermediate transfer belt 10 wound around the downstream backup roller 75 in the first separation state is less than the contact state. The tension and the amount of the intermediate transfer belt 10 wound around the downstream backup roller 75 in the second separation state is less than the first separation state.

In the first separation state, the distance D1 is configured relatively small, for example, 4 mm, and the tension and the amount of the intermediate transfer belt 10 wound around the downstream backup roller 75 are smaller than in the contact state. By contrast, in the second separation state, the distance D2 is configured relatively long, for example, 17 mm, and the tension and the amount of the intermediate transfer belt 10 wound around the downstream backup roller 75 are smaller than in the first separation state.

According to the present embodiment, the auxiliary roller 91 is provided to the support member 81 of the primary transfer portion for the color of black. In addition to the auxiliary roller 91, an auxiliary roller may be provided to the support member 83 of the primary transfer portion of the color of yellow, magenta, and cyan.

Figure 7:
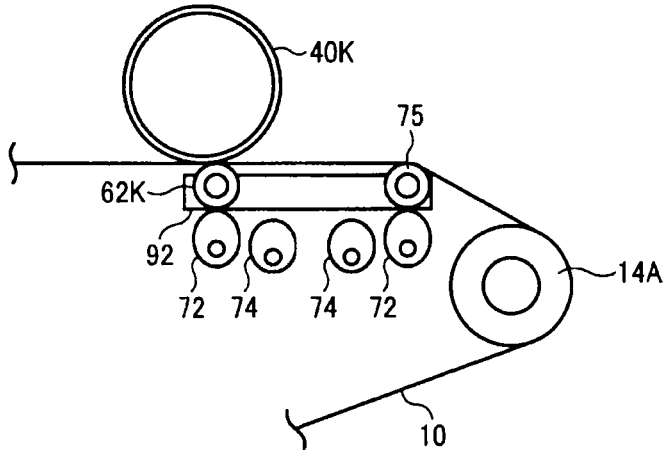
FIGS. 7(*a*) through 7(*c*) are partially enlarged schematic diagrams illustrating the transfer unit in different states according to still another illustrative embodiment of the present invention.
Figure 7:
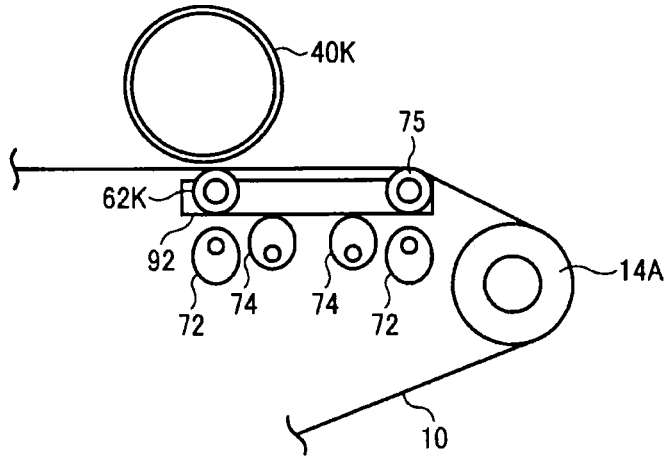
Figure 7:
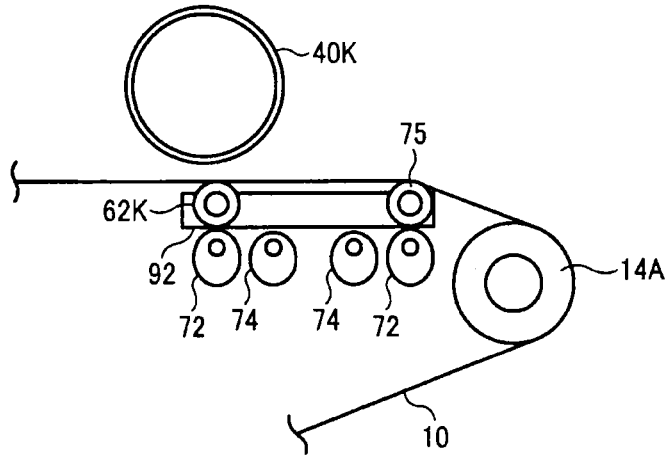

Referring now to FIGS. 7(*a*) through 7(*c*), there are provided partially enlarged schematic diagrams illustrating the position adjuster according to another illustrative embodiment of the present invention. FIG. 7(*a*) illustrates the contact state. FIG. 7(*b*) is the first separation state. FIG. 7(*c*) is the second separation state.

According to the present embodiment, a support member 92 is provided in place of the support member 81. The support member 92 does not rotate about a rotary shaft. The entire support member 92 moves away from the intermediate transfer belt 10, which is different from the foregoing embodiments.

While the support member 92 rotatably supports the transfer roller 62K and the downstream backup roller 75, the support member 92 is movable up and down by a linear guide, not illustrated.

Substantially below the support member 92, two first cams 72 are arranged such that the positions thereof in the vertical direction are horizontal. Similarly, two second cams 74 are aligned such that the positions thereof in the vertical direction are horizontal. The two second cams 74 are disposed lower than the two first cams 72. The top dead center of the second cams 74 is substantially higher than the bottom dead center of the first cams 72.

Rotation of the first cams 72 and the second cams 74 disposed below the support member 92 enables the support member 92 to move from the contact state shown in FIG. 7(*a*) in which the intermediate transfer belt 10 is in contact with the photoreceptor drum 40K, to the first and the second separation states shown in FIGS. 7(*b*) and 7(*c*), respectively, while maintaining the support member 92 parallel to the intermediate transfer belt 10.

In this configuration, it is also possible to adjust the distance between the photoreceptor drum 40K and the intermediate transfer belt 10 as in the foregoing embodiments.

The description has been provided of the support member 92 of the primary transfer portion for the color black, which moves vertically while remaining parallel to the intermediate transfer belt 10. The same support member may be provided to the primary transfer portion for other colors.

It will be understood by those skilled in the art that various changes in form and detail may be made therein without departing from the spirit and scope of the invention.

For example, the photoreceptor drum 40K may be adjusted between the contact state, the first separation state, and the second separation state while the photoreceptor drums 40C, 40M, and 40Y may be adjusted only between the contact state and the first separation state.

Alternatively, in a case of four photoreceptor drums 40C, 40M, 40Y, and 40K arranged in tandem on the same plane, the position adjuster may be provided only to an image forming station including the photoreceptor drum 40K for black.

Still alternatively, the backup rollers each supporting each one of the photoreceptor drums 40C, 40M, 40Y, and 40K may be independently provided, thereby enabling four photoreceptor drums to independently separate from the intermediate transfer belt 10.

In the illustrative embodiments, the position of the intermediate transfer belt can be changed at different positions by sequentially rotating two cams. Alternatively, a single part is used as the position adjuster that can change the position of the intermediate transfer belt at different positions.

Alternatively, the first cam and the second cam may be rotated either manually or automatically. For example, the first cam and the second cam may be rotated automatically.

Alternatively, the intermediate transfer belt may be detached without any belt tension in the second separation state. Alternatively, in the second separation state, the intermediate transfer belt may be tensioned, but the belt tension may be reduced by moving the support rollers and so forth to detach the intermediate transfer belt.

According to the illustrative embodiments, the support member 92 is movable in the vertical direction. However, the moving direction thereof is not limited to the vertical direction. For example, the support member 92 may be movable from the contact state shown in FIG. 7(*a*) to the bottom right direction or the bottom left direction.

According to the illustrative embodiment, when the copier main body 100 receives the print information of a monochrome image or a color image and image forming operation is started, the position adjuster consisting of a motor or a solenoid for the monochrome image transfer unit enables the first cam 72 to rotate, thereby moving the transfer roller 62K to the contact position at which the transfer roller 62K contacts the intermediate transfer belt 10.

When the image forming operation is finished, the motor or the solenoid of the position adjuster for the monochrome image transfer unit enables the first cam 72 to rotate. Subsequently, the transfer roller 62K moves to the first separation position.

When the transfer unit or the photoreceptor drums needs to be removed from the copier main body 100, the lever or the button of the position adjuster is manually controlled to rotate the second cam 74, thereby enabling the transfer roller 62K to move from the first separation position to the second separation position.

Alternatively, the position adjuster 70 of the monochrome image transfer unit may also control the position of the downstream backup roller 75 disposed downstream from the transfer roller 62K in the traveling direction of the intermediate transfer belt 10 in order to equalize the size of the nip at the plurality of the primary transfer portions.

At this time, the position adjuster 70 of the monochrome image transfer unit enables the downstream backup roller 75 to position the intermediate transfer belt 10 at the plurality of positions: at the contact position at which the intermediate transfer belt 10 contacts horizontally the plurality of the photoreceptor drums 40C, 40M, 40Y, and 40K; at the first separation position at which the intermediate transfer belt 10 separates from the photoreceptor drums 40C, 40M, 40Y, and 40K; and at the second separation position at which the intermediate transfer belt 10 separates further away the photoreceptor drums 40C, 40M, 40Y, and 40K from the first separation position.

The first separation position can be configured at the position at which the intermediate transfer belt 10 and the photoreceptor drum 40K are in proximity to each other regardless of removability of the transfer unit and the photoreceptor drums, thereby reducing fluctuation of the belt tension between image forming operation and the standby state. In other words, the removability of the transfer unit and the photoreceptor drums does not need to be taken into consideration in this state.

Accordingly, an error in the control of the position of the intermediate transfer belt 10 in the main scanning direction is suppressed or prevented. Further, the intermediate transfer belt 10 is prevented from drifting, slipping, and/or being loosened.

The removability of the intermediate transfer belt 10 or the intermediate transfer device can be achieved at the second separation position. At the second separation position, the intermediate transfer belt 10 is not rotated. Thus, the intermediate transfer belt 10 and the photoreceptor drum 40K can be separated significantly from one another without concerning fluctuation of the tension of the belt and unstable control of drift of the intermediate transfer belt 10. This prevents the intermediate transfer belt 10 and the photoreceptor drum 40K from undesirably contacting each other and getting damaged. For example, the intermediate transfer belt 10 is prevented from getting caught and thus damaged.

As described above, the belt tension is maintained at the first separation position. At the second separation position, enough space for removal of the transfer unit or the photoreceptor drums can be secured without paying a special attention to the tension of the belt.

The difference between the first separation position and the contact position can be configured relatively small so that the amount of travel of the transfer roller 62K and the backup roller 75 can be minimized. When the amount of the intermediate transfer belt 10 wound around the downstream backup roller 75 is smaller than around the tension roller, the fluctuation of the tension of the belt can be reduced as the downstream backup roller 75 moves, if not prevented entirely.

According to the illustrative embodiment, the position adjuster of the transfer unit 71 can adjust the plurality of the transfer rollers 62 and the photoreceptor drums 40 at different positions. In particular, the positions include the contact position at which the plurality of the transfer rollers 62C, 62M, and 62Y contacts the photoreceptor drums 40C, 40M, and 40Y; the first separation position at which the plurality of transfer rollers 62C, 62M, and 62Y separates from the photoreceptor drums 40C, 40M, and 40Y; and the second separation position at which the plurality of transfer rollers 62C, 62M, and 62Y separates further away from the photoreceptor drums 40C, 40M, and 40Y than in the first separation position.

The position adjuster 71 may also adjust the position of the upstream backup roller 78 disposed upstream from the transfer roller 62C which is the most upstream of the transfer rollers 62C, 62M, and 62Y in the traveling direction of the intermediate transfer belt 10.

In such a case, the backup roller 78 is controlled by the position adjuster 71 such that the position of the intermediate transfer belt can be controlled at different positions: at the contact position at which the intermediate transfer belt 10 contacts horizontally the photoreceptor drums 40C, 40M, and 40Y; at the first separation position at which the intermediate transfer belt 10 separates from the photoreceptor drums 40C, 40M, and 40Y; and the second separation position at which the intermediate transfer belt 10 separates further away from the photoreceptor drums 40C, 40M, and 40Y than in the first separation position.

When the copier main body 100 receives a color image information and image forming operation is initiated, the motor or solenoid of the position adjuster 71 enables the plurality of transfer rollers 62C, 62M, and 62Y to move to the contact position. After completion of the image forming operation, the motor or the solenoid of the position adjuster 71 enables the transfer rollers 62C, 62M, and 62Y to move to the first separation position.

In a case in which the copier main body 100 receives the monochrome image print information, the image forming operation is performed while the transfer roller 62K remains at the first separation position.

When the transfer unit or the photoreceptors needs to be removed from the image forming apparatus, the lever of the position adjuster or the button is operated so as to move the transfer rollers 62C, 62M, and 62Y from the first separation position to the second separation position.

The first separation position can be configured at the position at which the intermediate transfer belt 10 and the photoreceptor drums 40C, 40M, and 40Y are in proximity to each other regardless of removability of the transfer unit and the photoreceptor drums, thereby minimizing fluctuation of the belt tension between image forming operation and the standby state. In other words, the removability of the transfer unit and the photoreceptor drums does not need to be taken into consideration at the first separation position.

With this configuration, an error in the control of the position of the intermediate transfer belt 10 in the main scanning direction is suppressed or prevented. Further, the intermediate transfer belt 10 is prevented from drifting, slipping, and being loosened. The removability of the intermediate transfer belt 10 or the intermediate transfer device can be achieved at the second separation position.

At the second separation position, the intermediate transfer belt 10 is not rotated. Thus, the intermediate transfer belt 10 and the photoreceptor drums 40C, 40M, and 40Y can be separated significantly from one another without considering fluctuation of the tension of the belt and unstable control of drift of the intermediate transfer belt 10. This prevents the intermediate transfer belt 10 and the photoreceptor drums 40C, 40M, and 40Y from undesirably contacting each other and getting damaged. For example, the intermediate transfer belt 10 is prevented from getting caught and thus damaged. This configuration is advantageous when removing the intermediate transfer device or the photoreceptors. At the separation position, the belt tension is maintained. By contrast, at the second separation position, the tension of the belt does not need to be taken into consideration, and the enough gap between the intermediate transfer belt 10 and the photoreceptor drums 40C, 40M, and 40Y can be secured.

Therefore, the difference between the first separation position and the contact position is made small so that the traveling distance of the 62C, 62M, and 62Y and the upstream backup roller 78 is made small. By reducing the amount of the intermediate transfer belt 10 wound around the upstream backup roller 78 less than around the tension roller, the fluctuation of the belt tension as the upstream backup roller 78 moves can be minimized.

According to the foregoing illustrative embodiments, when the intermediate transfer belt is separated from the rotating image bearing members, stress against the intermediate transfer belt and the image bearing members is suppressed, and fluctuation of the belt tension is reduced, if not prevented entirely. Moreover, the intermediate transfer belt is prevented from drifting in the main scanning direction and getting loosened or slipped. Upon replacement of the intermediate transfer belt and the image bearing members, the intermediate transfer belt is prevented from contacting other parts, preventing damage.

According to the illustrative embodiments, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A transfer device, comprising:

a plurality of rollers;

a rotatable intermediate transfer belt wrapped around the plurality of the rollers;

a transfer roller disposed in an inner loop of the intermediate transfer belt and facing a photoreceptor of an image forming apparatus within which the transfer device is installed, the photoreceptor disposed at an outer circumference of the intermediate transfer belt, to transfer an image formed on the photoreceptor when contacting the intermediate transfer belt;

a frame that rotatably supports the transfer roller; and a cam that movably supports the frame to adjust a position of the intermediate transfer belt at a plurality of positions relative to the photoreceptor, the plurality of positions including a contact state in which the intermediate transfer belt having a first predetermined tension contacts the photoreceptor, a first separation state in which the intermediate transfer belt having a second predetermined tension separates from the photoreceptor, and a second separation state in which the intermediate transfer belt separates further away from the photoreceptor than in the first separation state, wherein, in the first separation state, the intermediate transfer belt is driven and a lubricating agent is applied on the intermediate transfer belt.

2. The transfer device according to claim 1, wherein in the second separation state, at least one of the intermediate transfer belt and the photoreceptor is removed from the image forming apparatus.

3. The transfer device according to claim 1, wherein the cam includes a first cam and a second cam, and wherein the first cam movably supports the frame at a top dead center thereof in the contact state, the second cam movably supports the frame at a top dead center thereof in the first separation state, and either the first cam or the second cam supports the frame at a bottom dead center thereof in the second separation state.

4. The transfer device according to claim 3 further comprising:

an automatic driving device to drive the first cam automatically; and a manual driving device to drive the second cam manually.

5. The transfer device according to claim 4, wherein the automatic driving device includes a motor or a solenoid.

6. The transfer device according to claim 1, wherein the second predetermined tension is less than the first predetermined tension.

7. The transfer device according to claim 1, wherein the intermediate transfer belt has a third predetermined tension in the second separation state, and the third predetermined tension is less than the second predetermined tension.

8. The transfer device according to claim 7, wherein the second predetermined tension is less than the first predetermined tension.

9. The transfer device according to claim 1, further comprising a cleaning device to remove toner remaining on the intermediate transfer belt, wherein the lubricating agent is stored in the cleaning device.

10. The transfer device according to claim 1, wherein in the first separation state, the transfer roller is in contact with the intermediate transfer belt.

11. The transfer device according to claim 1, further comprising:

a plurality of photoreceptors; and a plurality of transfer rollers.

12. A transfer device, comprising:

a plurality of rollers;

a rotatable intermediate transfer belt wrapped around the plurality of the rollers;

a transfer roller disposed in an inner loop of the intermediate transfer belt and facing a photoreceptor of an image forming apparatus within which the transfer device is installed, the photoreceptor disposed at an outer circumference of the intermediate transfer belt, to transfer an image formed on the photoreceptor when contacting the intermediate transfer belt;

a frame that rotatably supports the transfer roller; and a cam that movably supports the frame to adjust a position of the intermediate transfer belt at a plurality of positions relative to the photoreceptor, the plurality of positions including a contact state in which the intermediate transfer belt having a first predetermined tension contacts the photoreceptor, a first separation state in which the intermediate transfer belt having a second predetermined tension separates from the photoreceptor, and a second separation state in which the intermediate transfer belt separates further away from the photoreceptor than in the first separation state, wherein, in the first separation state, transfer processing is in a standby state or a lubricating agent is automatically applied to the intermediate transfer belt.

13. The transfer device according to claim 12, wherein in the second separation state at least one of the intermediate transfer belt and the photoreceptor is removed from the image forming apparatus.

14. The transfer device according to claim 12, wherein the cam includes a first cam and a second cam, and wherein the first cam movably supports the frame at a top dead center thereof in the contact state, the second cam movably supports the frame at a top dead center thereof in the first separation state, and either the first cam or the second cam supports the frame at a bottom dead center thereof in the second separation state.

15. The transfer device according to claim 14 further comprising:

an automatic driving device to drive the first cam automatically; and a manual driving device to drive the second cam manually.

16. The transfer device according to claim 12, wherein the second predetermined tension is less than the first predetermined tension.

17. The transfer device according to claim 12, wherein the intermediate transfer belt has a third predetermined tension in the second separation state, and the third predetermined tension is less than the second predetermined tension.

18. The transfer device according to claim 17, wherein the second predetermined tension is less than the first predetermined tension.

19. The transfer device according to claim 12, wherein in the first separation state, the transfer roller is in contact with the intermediate transfer belt.

20. The transfer device according to claim 12, further comprising:

a plurality of photoreceptors; and a plurality of transfer rollers.

* * * * *